US008471162B2

(12) United States Patent
Scola et al.

(10) Patent No.: US 8,471,162 B2
(45) Date of Patent: Jun. 25, 2013

(54) SWITCHING DEVICE FOR LOW VOLTAGE SYSTEMS

(75) Inventors: Edoardo Scola, Lecco (IT); Luigi Arturo Degli Innocenti, Bergamo (IT)

(73) Assignee: ABB S.p.A., Milan (IT)

( * ) Notice: Subject to any disclaimer, the term of this patent is extended or adjusted under 35 U.S.C. 154(b) by 367 days.

(21) Appl. No.: 12/865,563

(22) PCT Filed: Jan. 19, 2009

(86) PCT No.: PCT/EP2009/050565
§ 371 (c)(1),
(2), (4) Date: Aug. 2, 2010

(87) PCT Pub. No.: WO2009/095330
PCT Pub. Date: Aug. 6, 2009

(65) Prior Publication Data

US 2010/0326802 A1 Dec. 30, 2010

(30) Foreign Application Priority Data

Jan. 31, 2008 (IT) ..... MI2008A0158

(51) Int. Cl.
*H01H 13/04* (2006.01)

(52) U.S. Cl.
USPC ..... 200/303

(58) Field of Classification Search
CPC ..... H01H 13/04
USPC ..... 200/303, 309, 318
See application file for complete search history.

(56) References Cited

U.S. PATENT DOCUMENTS

| | | | | | |
|---|---|---|---|---|---|
| 4,297,663 | A | * | 10/1981 | Seymour et al. | 200/303 |
| 4,786,885 | A | * | 11/1988 | Morris et al. | 200/309 |
| 5,440,088 | A | | 8/1995 | Coudert et al. | |
| 5,539,168 | A | * | 7/1996 | Linzenich | 200/303 |

(Continued)

FOREIGN PATENT DOCUMENTS

| | | | |
|---|---|---|---|
| CN | 1364303 | A | 8/2002 |
| EP | 0591074 | A1 | 4/1994 |
| EP | 1098337 | A2 | 5/2001 |
| EP | 2028674 | A2 | 2/2009 |

OTHER PUBLICATIONS

Notification of First Office Action, Chinese Application No. 200980103654.4, dated Aug. 10, 2012.

(Continued)

*Primary Examiner* — Briggitte R Hammond
(74) *Attorney, Agent, or Firm* — Novak Druce Connolly Bove + Quigg LLP

(57) ABSTRACT

The present invention relates to a switching device for low voltage systems comprising one or more accessory devices. The switching device according to the invention comprises a case containing at least one pair of contacts that can be reciprocally coupled/decoupled. The device furthermore comprises a containment structure to contain at least one accessory device of the switching device. Said structure is provided with means for interfacing with the accessory device which comprises a body that can be inserted in the containment structure. The accessory device also comprises coupling means to couple it to the containment structure and operating means which interact with the switching device via the interface means of the containment structure. The accessory device is also provided with disengagement means operatively connected to the coupling means. Said disengagement means, once activated, free the coupling means to permit extraction of the accessory device from the containment structure.

20 Claims, 14 Drawing Sheets

U.S. PATENT DOCUMENTS

| | | | | |
|---|---|---|---|---|
| 6,232,859 | B1 | 5/2001 | Christensen et al. | |
| 7,385,153 | B1 * | 6/2008 | Bogdon et al. | 200/303 |
| 7,566,841 | B2 * | 7/2009 | McCoy | 200/331 |
| 7,923,650 | B2 * | 4/2011 | Greenberg et al. | 200/50.32 |
| 7,961,480 | B2 * | 6/2011 | Besana et al. | 361/837 |
| 7,973,622 | B2 * | 7/2011 | Yang et al. | 200/308 |
| 2003/0206092 | A1 | 11/2003 | Rodriguez et al. | |
| 2006/0141849 | A1 * | 6/2006 | Trout | 439/465 |
| 2007/0171010 | A1 * | 7/2007 | Zindler | 335/16 |

OTHER PUBLICATIONS

Notification of the Second Office Action, Chinese Application No. 200980103654.4, dated Feb. 8, 2013.

* cited by examiner

SWITCHING DEVICE FOR LOW VOLTAGE SYSTEMS

CROSS REFERENCE TO RELATED APPLICATIONS

This application is a 35 U.S.C. §371 National Stage filing of International Application No. PCT/EP2009/050565, filed Jan. 19, 2009, which claims priority to Italian Patent Application No. MI2008A000158, filed Jan. 31, 2008. The entire contents of each of the above-applications are incorporated herein by reference.

The present invention relates to a switching device for low voltage systems comprising one or more accessory devices.

It is known that low voltage switching devices (i.e. for applications with operating voltages up to 1000V AC/1500V DC, for example automatic switches, disconnectors and contactors, universally known as switching devices and hereinafter for the sake of brevity referred to as switches, are devices designed to permit the correct operation of specific parts of electrical systems and of the loads installed. Automatic switches, for example, ensure that the required rated current can flow towards the various utilities, permitting correct connection and disjunction of the loads to and from the circuit and automatic disconnection of the protected circuit with respect to the electrical energy source. The devices that recognise anomalous functioning of a specific system branch and consequently intervene by opening at least one of the switches in the circuit are normally called protection units. The commonest types of protection unit are thermal, magnetic, thermo-magnetic, electronic or a combination of said types.

It is known that the switches comprise a case and one or more electric poles, each combined with at least one pair of contacts which can be reciprocally coupled/decoupled. The switches of the known art also comprise control means which produce the relative movement of the contact pairs so that they set to at least one coupling position (circuit closed) and one separation position (circuit open).

The switches can also be commonly provided with various additional accessories. These include, for example, auxiliary contacts for signalling the switch status (open, closed or tripped), opening, closing and reset actuators (for example solenoid commands, motor commands, spring loading devices), minimum and maximum voltage release devices, temperature sensors and other.

The accessories of the known art are generally housed inside the switch case, each according to particular requirements. In particular the accessories are fixed and wired in the switch by means of auxiliary circuits or buses assigned to the various functions of power supply, command or transfer of information.

The switches conceived as above are traditionally crossed in various ways by different types of auxiliary cables for connection of the accessory devices. Said cables can remain confined within the volume of the switch or terminate outside the same for connections with other parts of the system, for example displays, buttons and electronic control units, interlock systems, dialogue units or supervision units.

A first example of a switch comprising a plurality of accessory devices is described in the patent application U.S. Pat. No. 5,539,168. In this known solution, the accessory devices are inserted in housing structures defined inside the switch case. More specifically, the accessories are first inserted in a tilted position with respect to the housing structure so that guide means predisposed on the accessory interact with other means predisposed in the housing structure. Said means substantially guide insertion of the accessory in the housing until it reaches a coupling position in which a flexible element emerging from the housing structure snap-fits into a recess in the accessory, locking it in its characteristic operating position.

A second example of switch comprising a plurality of accessory devices is described in the patent application WO 01/69632. In this solution the accessories comprise first connection means predisposed on opposite walls and designed to connect to second connection means predisposed on corresponding opposite walls of the housing structure. More specifically, the accessory is tilted during insertion so as to connect a first wall of the accessory to a corresponding wall of the housing structure. Subsequently the accessory is positioned so as to permit coupling also of the other wall of the accessory with the corresponding wall of the housing structure.

The solutions described above have the common drawback of requiring a high level of operator attention when inserting the accessory in the housing structure. As indicated above, said insertion must be guided by partially tilting the accessory to allow the guide means to interact. Any extraction of the accessory from the housing requires the same procedure. In other words, the time required for the operations depends in practice on the ability of the operator. This obviously makes the procedure fairly difficult and inconvenient.

Another extremely disadvantageous aspect of the first solution described lies in the connection means which fix the accessory in the correct operating position. As indicated, said means consist of flexible ends emerging from the housing structure and usually made in one single piece with the same. In the event of breakage of these ends, the entire housing structure, i.e. in practice the entire part of the case defining said housing structures, has to be replaced.

Another negative aspect of the solutions indicated lies in the fact that they require a particularly complicated geometrical configuration of the parts coupled. In the first example said disadvantageous aspect lies in the shape of the accessory housing structure, and in the second case in the external configuration of the accessory and the form of the connection means which permit positioning of said accessory.

A third example of switch provided with a plurality of accessory devices is described in the patent application EP 0591074. In this further solution the accessory comprises a flexible coupling portion which has the function of coupling one end of the switch structure once the accessory has been inserted.

Although relatively effective in functional terms, the latter solution has an evident limit due to the fact that the accessory is difficult to extract from the housing. More specifically, said extraction is performed by means of an extraction key or alternatively by providing coupling systems combined with the housing structure. Both these possibilities are disadvantageous as they involve a lengthy extraction phase and considerably complicate the configuration of the accessory and housing. Furthermore the inappropriate use of keys or other equivalent extraction devices can damage the accessories installed in the switch.

The above clearly indicates the need for alternative technical solutions to the current ones to solve the drawbacks of the connection of accessories to a switch. Therefore the main aim of the present invention is to provide a switching device that overcomes the above drawbacks.

This aim and others which will be illustrated below are achieved by a single-pole or multi-pole switching device for low voltage systems characterised in that it comprises:

- a case containing at least one pair of contacts that can be reciprocally coupled/decoupled;

at least one containment structure to contain at least one accessory device of the switching device, said structure comprising means for interfacing with said accessory device;

at least one accessory device comprising a body that can be inserted in the containment structure and provided with coupling means for coupling it to said containment structure;

said accessory device comprising operative means for interacting with the switching device via the interface means of the containment structure, said accessory device being provided with disengagement means operatively connected to the coupling means, said disengagement means, once activated, freeing the coupling means to permit extraction of the accessory device from the containment structure.

The use of disengagement means combined with the body of the accessory constitutes an important advantage of the invention since it permits easy extraction of the accessory from the containment structure in which it is inserted.

Further characteristics and advantages will emerge from the description of preferred but not exclusive embodiments of the switching device according to the invention, illustrated by way of non-limiting example with the help of the accompanying drawings in which.

Figure 1:
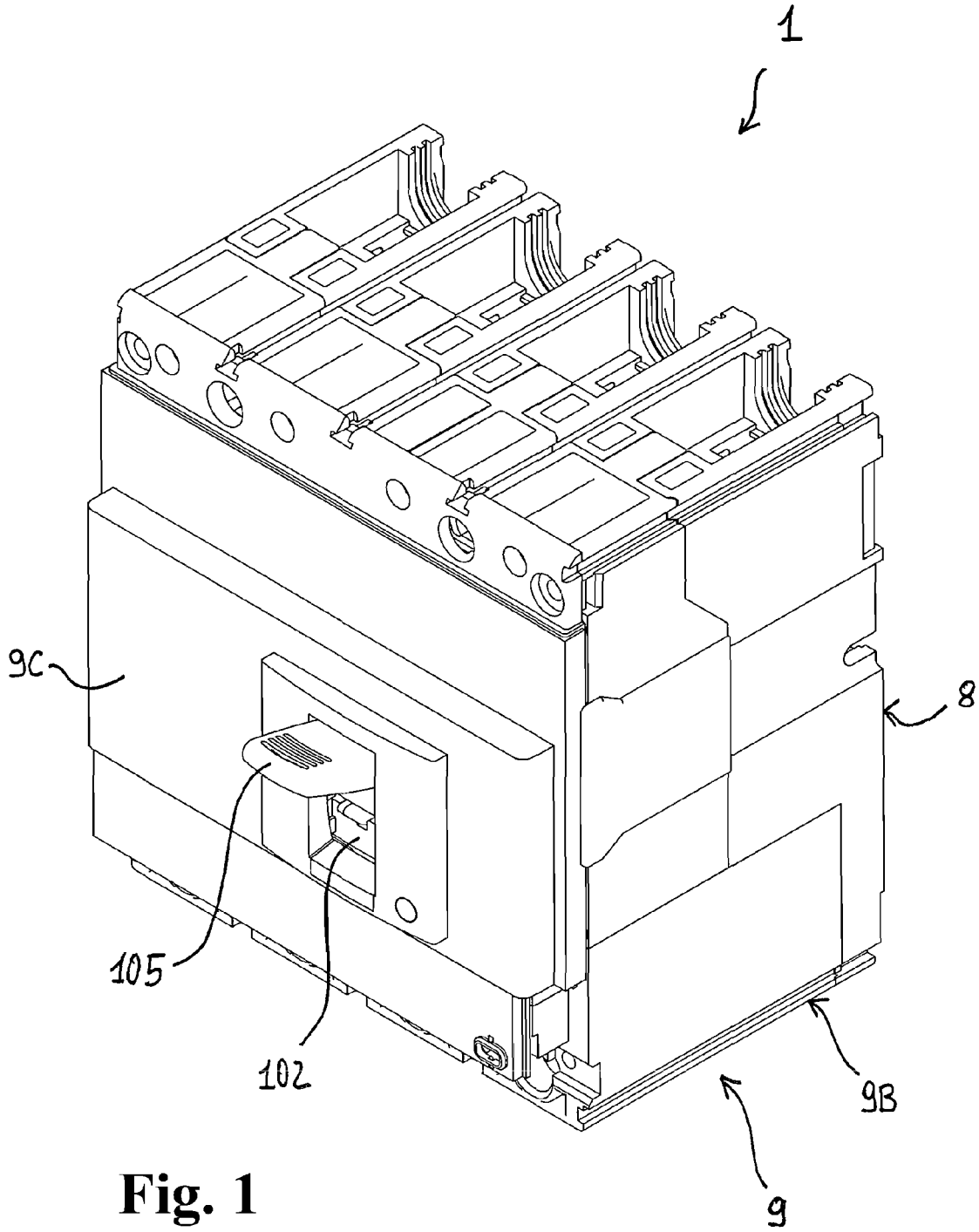
FIG. 1 is a perspective view of a first embodiment of the switching device according to the present invention.

With reference to the figures cited, the single-pole or multipole switching device 1 comprises a case 9 containing at least one pair of contacts that can be reciprocally coupled/decoupled to/from each other. More specifically, the switching device 1 comprises one stationary contact and at least one movable contact for each pole provided. Said contacts can be reciprocally coupled/decoupled at the level of a breaking cavity inside the case 9. In the embodiment illustrated in the figures cited, the switching device 1 is configured so as to actuate a double break. For this reason, for each pole provided, the switching device 1 comprises a first pair of contacts and a second pair of contacts which couple/decouple at the level of a first 81 and a second breaking cavity 82 (see FIG. 8).

It is understood, however, that the technical solutions described below apply to any type of switching device, this expression including automatic switches, contactors and/or disconnectors. Below instead of the expression "switching device 1" the expression "switch 1" will also be used without wishing in any way to limit the scope of application of the present invention.

The switch 1 comprises at least one containment structure 20,20B,20C which defines a seat designed to contain one or more accessory devices 10 of the switching device 1 each of which performs a function of said switching device 1. Said function could be, for example, indication, command or control. An accessory device designed to actuate an indication function can comprise, for example, an auxiliary contact for signalling the status of the switch (open, closed, tripped or non-tripped). A command accessory device can comprise, for example, opening, closing and reset actuators or minimum and maximum voltage release devices. Lastly, an accessory device designed for a control function can comprise, for example, a temperature sensor or any other sensor able to monitor another variable characteristic of the operating status of the switching device 1. It is understood, however, that the containment structure 20,20B,20C is not limited to containing only accessory devices of the types described above but can obviously also contain accessory devices designed for different functions.

The containment structure 20,20B,20C according to the invention comprises means for interfacing 25 with said accessory device 10. Said interface means 25 in practice have the function of allowing operating means 26 of each accessory device 10 to interact directly or indirectly with other parts of the switch 1 relative to the function performed by said accessory device.

In a first possible configuration, for example, said interface means 25 can comprise one or more relay levers operatively connected to movable parts of the switch 1. Said levers in practice allow the operating means 26 of the accessory device 10 to indirectly interact with said movable parts of the switch 1. More specifically the levers could, for example, activate the operating means 26 of the accessory device 10 following a characteristic movement of said movable part of the switch 1. Vice versa the operating means 26 could activate the relay levers which in turn activate a movable part of the switch 1 substantially performing a command function.

In a further possible embodiment said operative interface means 25 could comprise one or more apertures defined on the walls of the containment structure 20,20B,20C to allow the operating means 26 of the accessory device 10 to directly interact with the other parts of the switch 1 involved in the function of said accessory device. If, for example, the accessory device 10 is provided with a temperature sensor, an aperture defined on the containment structure 20,20B,20C could advantageously have the purpose of allowing the operating means 26 to emerge from the structure 20 and locate in the most suitable position for detecting the temperature.

The switch 1 according to the invention comprises one or more accessory devices 10 each of which performs at least one function of the switch 1 as indicated above. Each accessory device 10 comprises a body 11 that can be inserted in the seat defined by the containment structure 20,20B,20C. Said body 11 is provided with coupling means 15 to couple the accessory device 10 to the containment structure 20. As specified in further detail below, the coupling means 15 couple to the structure 20,20B,20C at the level of a coupling surface 22 defined on a part of the structure 20,20B,20C.

The accessory device 10 comprises operating means 26 for interacting with the switch 1 via the interface means 25 of the containment structure 20,20B,20C. Said operating means, as indicated above, are configured so as to perform a particular function of the switch 1. If the accessory device 10 performs a control function, the first operating means could, for example, comprise sensor means which emerge from a surface of the body 11 of the accessory device 10 to detect a position or a status of the switch 1 (obviously once the accessory device 10 is coupled to the structure 20,20B,20C). If the accessory device 10 performs an indication function, then the operating means 26 can comprise, for example, a micro-switch 26B and an operating lever 26C which activates the micro-switch 26B after being in turn activated, directly or indirectly, by a movable part of the switch 1.

Said one or more accessory devices 10 according to the present invention comprise disengagement means 13 which, once activated, have the function of freeing the coupling means 15 from the containment structure 20,20B,20C. More specifically, the disengagement means 13 are operatively connected to the coupling means 15 so as to free the latter from the coupling surface 22 defined on the containment structure 20,20B,20C thus permitting extraction of the accessory device 10 from the structure. According to a preferred embodiment of the invention, described below, the coupling means 15 and the disengagement means 13 are made in one single body with the body 11 of the accessory device 10.

The technical solution described above makes the accessory device 10 particularly functional as it permits easier replacement. Unlike the traditional solutions, the accessory device 10 is extracted via an action performed on said device, via activation of the disengagement means 13, without the need to use keys or extraction accessories and without the need to design particular configurations of the structure 20,20B,20C to permit said extraction.

FIG. 1 is a view of a possible embodiment of the switch 1 according to the present invention. As illustrated, the case 9 comprises a box 9B delimited depthwise by a back wall 8. The case 9 is also provided with a cover 9C connected in a removable manner to the box 9B and positioned opposite the back wall 8. The cover 9C is provided with an aperture 102 from which an operating lever 105 protrudes which permits manual operation of the switch 1. More specifically, said lever 105 operates the command means 107 which move the movable contacts in order to open or close the switch.

Figure 2:
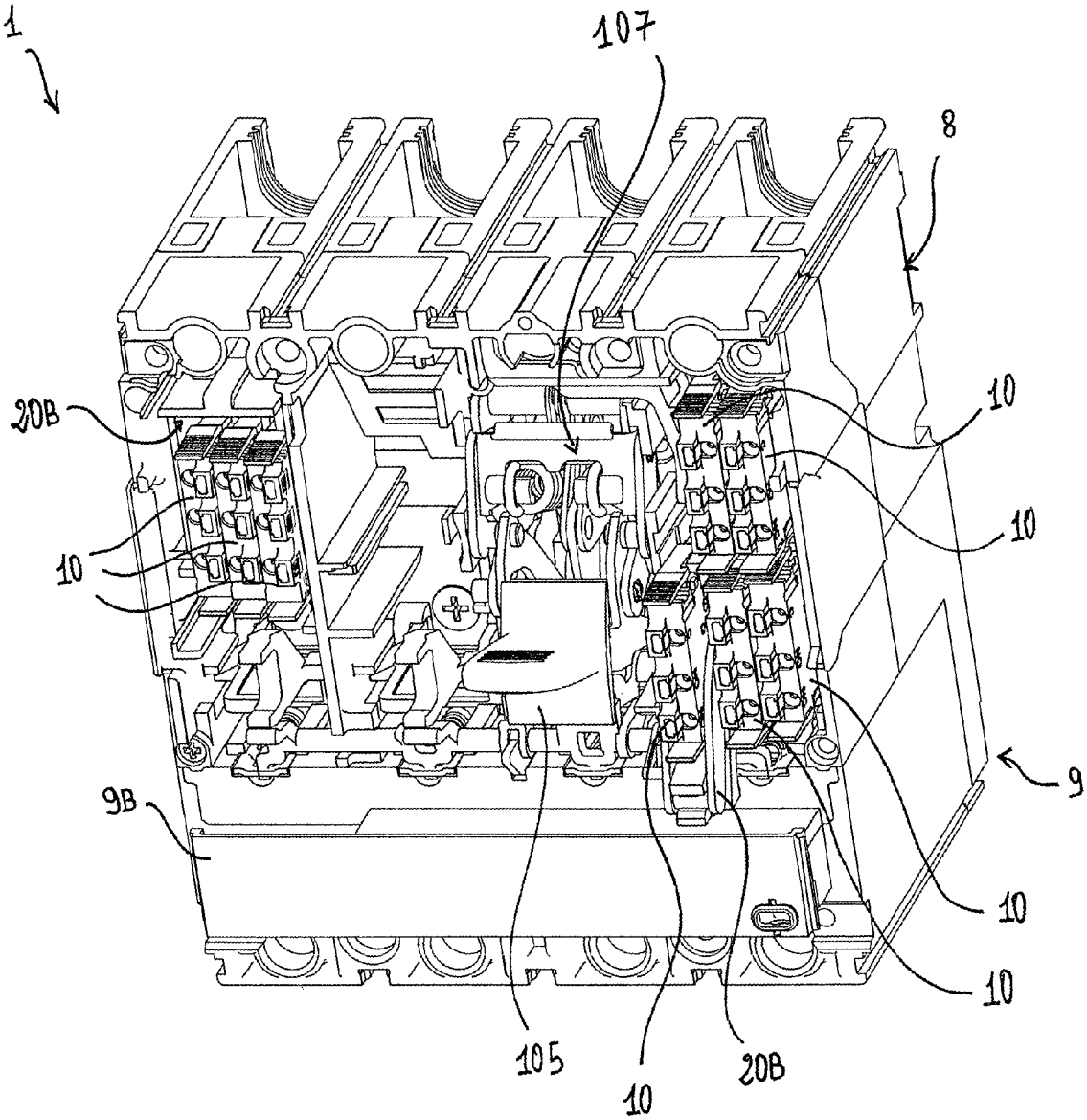
FIG. 2 is a perspective view of the device of FIG. 1 without the cover of the case and comprising a plurality of accessories.

FIG. 2 is a second perspective view of the switch 1 of FIG. 1 in which the case 9 is without the cover 9C. As can be seen, the switch 1 comprises a plurality of accessory devices 10 and a plurality of containment structures 20,20B,20C predisposed to contain said accessory devices 10. In particular, according to the invention, the switch 1 comprises at least one containment structure 20B,20C inserted in a removable manner in a corresponding housing cavity 50 defined inside the case 9. The switch 1 comprises preferably at least one containment structure 20 defined in a non-removable manner inside the case 9 of the switch 1. More precisely, according to a preferred embodiment of the invention, said at least one non-removable containment structure 20 is made in one single piece with said box 9B of the switch 1.

Figure 4:
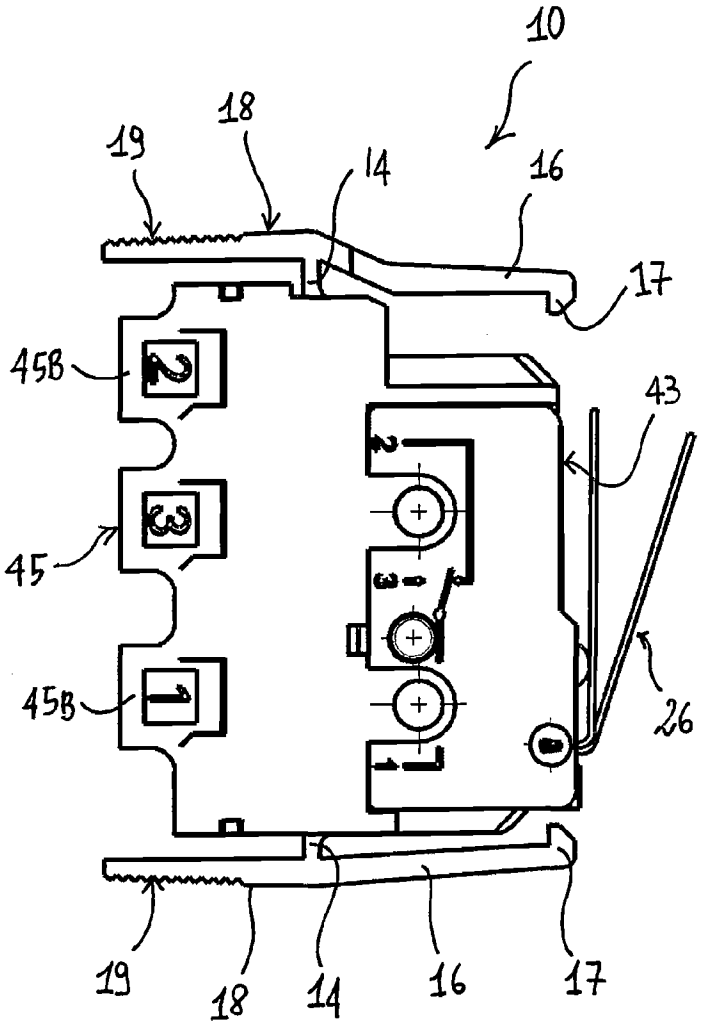
FIGS. 3 and 4 are a perspective view and a lateral view respectively of an accessory device of a switching device according to the present invention.
Figure 3:
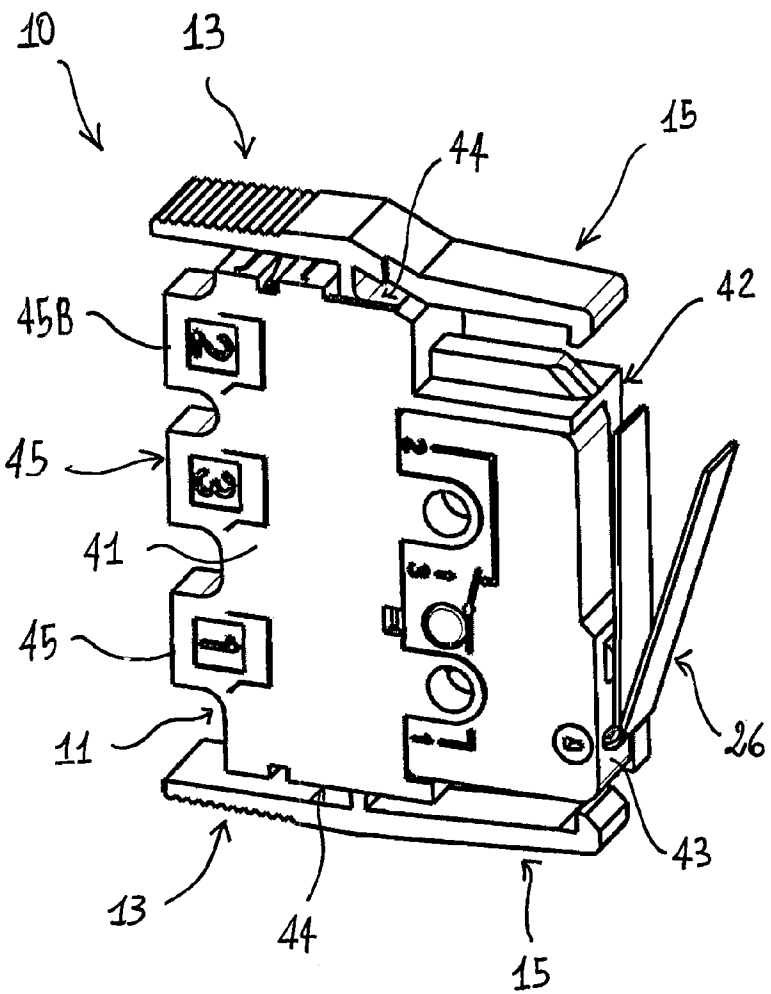

FIGS. 3 and 4 are views relative to a possible embodiment of an accessory device 10 according to the present invention. As illustrated in this embodiment, the coupling means 15 comprise a first lever arm 16 pivoting on a flexible fulcrum portion 14 emerging from a surface 44 of the body 11 of the accessory device 10. Said first arm 16 is provided with a free end 17 which couples to a corresponding coupling surface 22 of the containment structure 20,20B,20C when the accessory device 10 is inserted in the structure. The free coupling end 17 is maintained constantly in a position of substantial equilibrium due to the combined effect of the rigidity of the first lever arm 16 and the elastic reaction generated by the conformation of the fulcrum portion 14.

The disengagement means 13 comprise a second lever arm 18 operatively connected to the first arm 16 in order to counter, following its activation, the elastic reaction which acts on the coupling end 17. In practice the second arm 18, once activated, acts on the first lever arm 16 countering the elastic reaction which acts on the same and consequently freeing the coupling end 17 from the coupling surface 22. This last condition permits extraction of the accessory device 10 from the seat defined by the containment structure 20,20B, 20C.

According to a preferred embodiment of the invention, the first 16 and the second lever arm 18 are made in one single piece with the elastic fulcrum portion 14 and develop on opposite sides with respect to the latter. In other words the two arms 16,18 and the elastic fulcrum portion 14 are comparable, overall, to a first-class lever in which the fulcrum is positioned between the points of application of the resistant force represented by the elastic reaction that acts on the first arm 16 and the actuating force which can be exerted by an operator on an actuation portion 19 of the second lever arm 18. The lever arms 16,18 and the fulcrum portion 14 are sized (in terms of length, width and thickness) so as to give substantial rigidity to both the arms 16,18 and sufficient elasticity to the fulcrum portion 14.

In the embodiment illustrated in FIGS. 3 and 4, the accessory device 10 comprises a substantially prismatic-shaped body 11 provided with a first 41 and a second flat surface 42 substantially parallel to each other and a pair of reciprocally opposed lateral surfaces 44 which develop in directions substantially square to the flat surfaces 41,42. As illustrated, the coupling means 15 comprise in detail a pair of first lever arms 16, each of which pivots on a fulcrum portion 14 emerging from each of the opposed lateral surfaces 44. The disengagement means 13 comprise a pair of second lever arms 18 each of which are made in one single piece with a corresponding first lever arm 16. Each second lever arm 18 develops substantially parallel, but facing in opposite directions, to that of the corresponding first lever arm 16. In particular the second lever arm 18 develops, with respect to the body 11, so that the actuation portion 19 defined on it is accessible to an operator once the accessory device 10 is inserted in the containment structure 20.

The use of a pair of first reciprocally opposed lever arms 16 permits easy removal of the accessory device 10 and obviously permits stable coupling of the accessory device 10 in the seat defined by the containment structure 20,20B,20C. At the same time the use of a pair of second lever arms 18 facilitates extraction of the accessory device 10 as it provides an operator with two opposite gripping points with obvious operational advantages.

With reference again to FIGS. 3 and 4, the body 11 of the accessory device 10 comprises a first surface 43 where the operating means 26 which allow the accessory device 10 to perform the specific function of the switch 1 are positioned. Said first surface 43 develops substantially between the two opposite lateral surfaces 44 and substantially represents the surface of the body 11 which is inserted first in the containment structure 20,20B,20C.

In the solution illustrated, the operating means 26 of the accessory device 10 comprise a micro-switch 26B and a pair of operating levers 26C which activate the micro-switch 26B after being activated in turn, directly or indirectly, by a movable part of the switch 1, for example a lever operatively connected to the command means 107 of the switch 1 for example to signal the coupling or decoupling between the contacts of the switch 1.

The body 11 furthermore comprises a second surface 45, which provides the communication interface between the accessory device 10 and the other parts of the switch for example display, sensors or other accessories. In other words the second surface 45 is configured to allow the wiring of the accessory device 10 and/or the connection of auxiliary circuits/buses for powering or transferring information necessary for operation of the accessory device 10.

For said purpose the surface 45 is provided with one or more terminals 45B in which the connections necessary for said wiring or said connections can be inserted. Within the body 11 of the accessory device 10 illustrated in FIGS. 3 and 4, mechanical and/or electronic means are positioned which have the function of transforming a mechanical type signal, received at the input via the operating means 26, into an analog or digital type signal, for example, which is managed at the output via the terminals 45B defined on the second surface 45.

Figure 5:
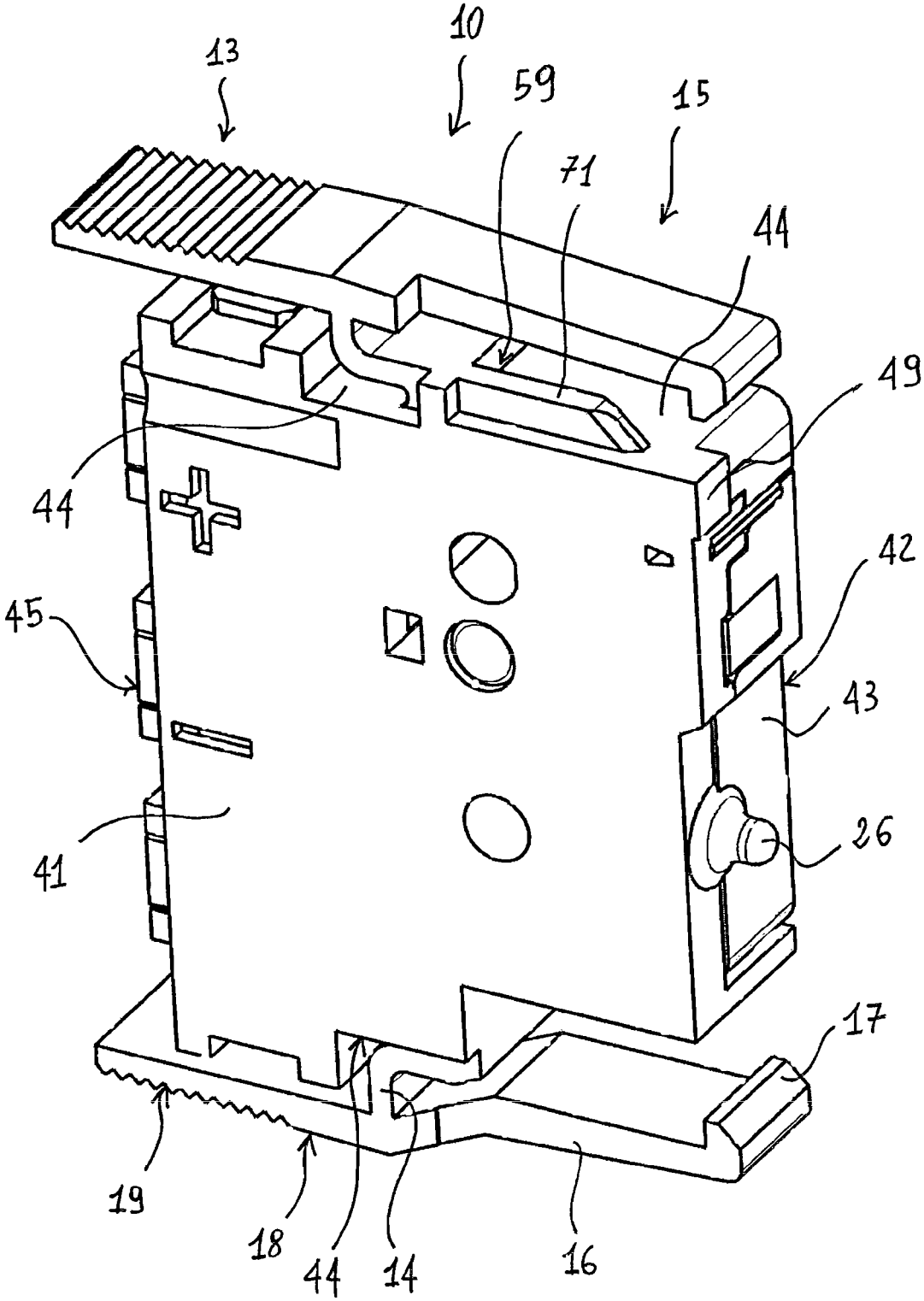
FIG. 5 is a perspective view relative to a further embodiment of an accessory device of a switching device according to the present invention.

FIG. 5 is a perspective view of a further embodiment of an accessory device 10 according to the present invention. In particular the accessory device 10 illustrated is predisposed to measure a characteristic temperature of the switch 1. As can be seen, the configuration of the body 11, the coupling means 15 and the disengagement means 13 remains substantially unchanged with respect to the solution illustrated in FIGS. 3 and 4. In this case, however, the operating means 26 comprise a temperature sensor, for example a thermocouple emerging from the operating surface 43 of the body 11. To support the temperature measurement function, the containment structure 20,20B,20C in which the accessory of FIG. 5 will be inserted, will be shaped so as to allow the accessory device 10 and the temperature sensor to set to the correct measuring position.

Again with reference to FIG. 5, the accessory device 10 advantageously comprises first guide means suitable for favouring insertion of the accessory device 10 in the seat defined by the containment structure 20,20B,20C. More specifically, said first guide means have the function of interacting with second guide means predisposed on the containment structure 20,20B,20C as described in further detail below.

In the solution of FIG. 5, the first guide means comprise one or more guide ends 71 which emerge from at least one of the lateral surfaces 44 defining the body 11 of the accessory device 10. In particular it can be seen that the guide end 71 develops mainly in a direction substantially parallel to the plane on which the flat surfaces 41,42 of the body 11 develop. Said direction coincides in practice with the direction of insertion in the corresponding containment structure 20,20B, 20C. The guide end 71 develops partly also in a direction square to the flat surfaces 41,42 so as to define a first locating surface 59 designed to contact a stop surface 49 of the containment structure 20,20B,20C as specified in further detail below. Alternatively the first locating surface 59 can be integrated or replaced with further locating surfaces, for example the surface indicated in FIG. 5 by reference 59B.

Figure 6:
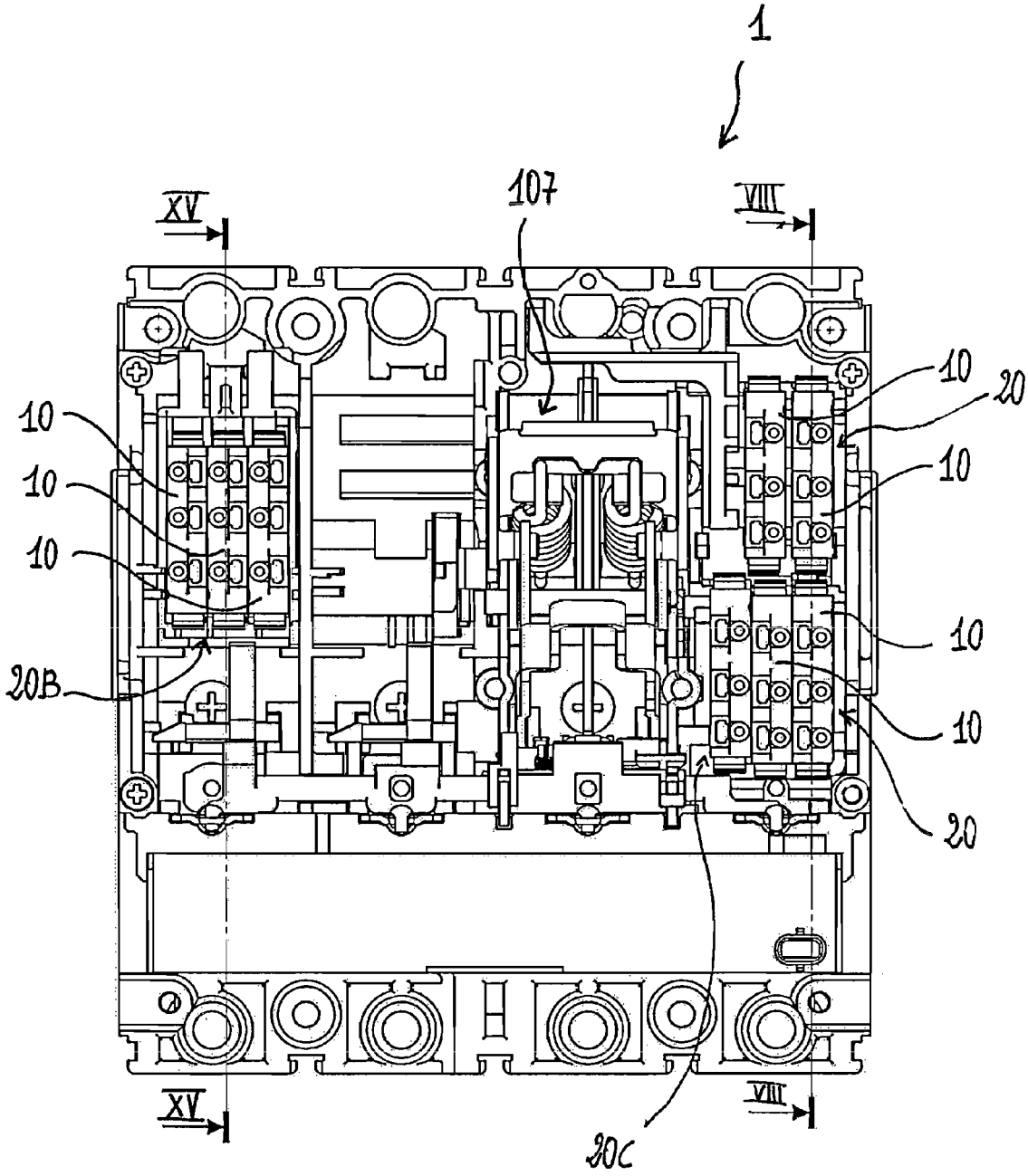
FIG. 6 is a front view of the switching device of FIG. 2.

FIG. 6 is a frontal view of the switch 1 illustrated in FIG. 2 and shows a possible layout of a plurality of accessory devices 10. The switch 1 is provided with a first 20B and a second containment structure 20C inserted in a removable manner in a corresponding housing cavity 50B, 50C defined inside the box 9B of the case 9. The use of containment structures 20B,20C which can be inserted in/removed from the structure of the box 9B improves the assembly operations to the advantage of the final production costs. The removable containment structures 20B,20C constitute in practice an interface between the accessory devices 10 and the box 9B functioning in practice as adapters. The use of removable containment structures 20B,20C is also advantageous as it increases the functional versatility of the switch 1. In fact, once the removable structure 20B,20C is extracted from the relative housing cavity 50B,50C, bulkier accessory devices than those that can be inserted in the containment structure 20B,20C can be positioned in said cavity.

Figure 7:
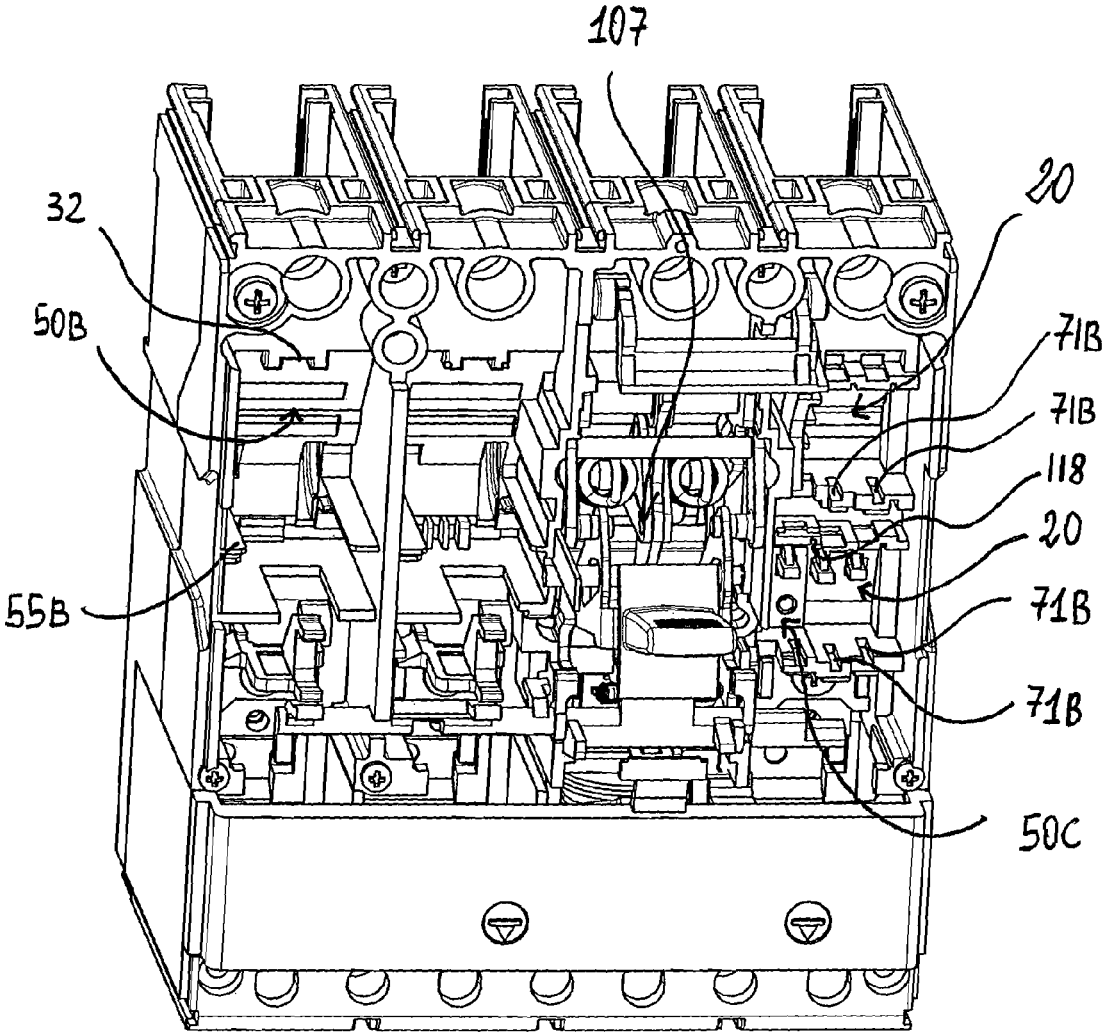
FIG. 7 is a perspective view of a second embodiment of a switching device according to the invention without accessory devices.

FIG. 7 is a perspective view of a possible embodiment of a switch 1 of FIG. 6 without the accessory devices 10 and the containment structures 20B,20C inserted in the box 9B in a removable manner. In particular said figure shows the configuration of the housing cavities 50B, 50C, described below, and the configuration of the non-removable containment structures 20 produced in one single piece with the box 9.

In said regard it is highlighted that said non-removable containment structures 20 are configured to each house a pair of accessory devices 10. The non-removable containment structures 20 in question are furthermore arranged so as to be substantially overlapping with respect to the vertical mode of installation of the switch shown in FIG. 7. Said layout permits installation of particularly bulky accessory devices if necessary which occupy the spaces relative to both containment structures 20.

It is understood, however, that they could be shaped differently, for example so as to contain a greater or lesser number of accessory devices. In the same way they could be provided in any internal position of the box 9B according, for example, to the type of accessory devices 10 to be installed in the structures.

Figure 8:
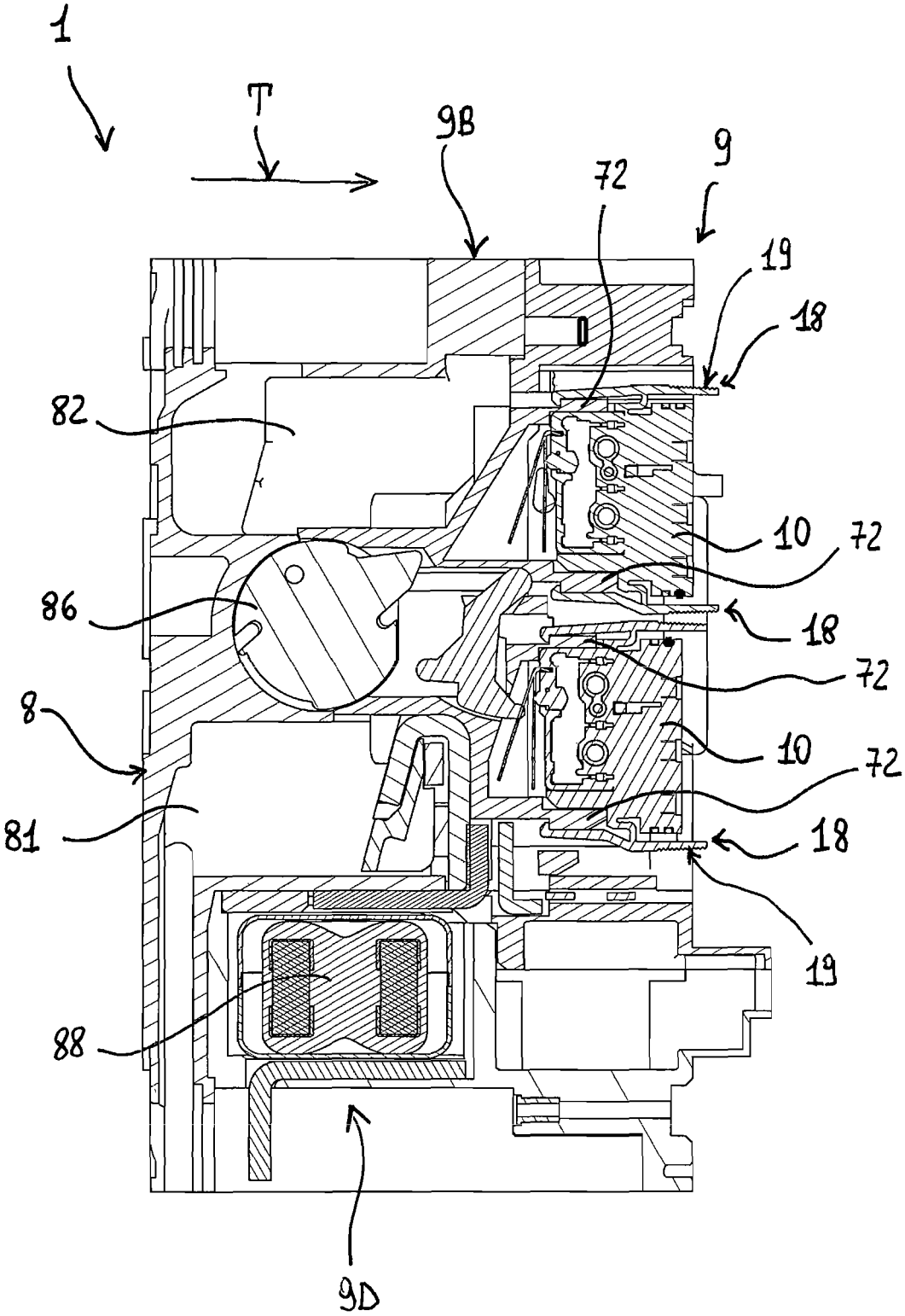
FIG. 8 is a section view according to the line VIII-VIII of FIG. 6.

FIG. 8 is a section view of the switch of FIG. 6 and shows the internal configuration of the same. As already mentioned, the switch 1 illustrated is of the double break type and comprises, for each pole, a first and a second pair of contacts which couple/decouple respectively at the level of a first 81 and a second breaking cavity 82. The movable contacts are moved by a moving element 86 which is operated by the command means 107 (shown for example in FIG. 7). Said means can be activated manually via a control lever 105 (see FIG. 1) or automatically following the intervention of a protection device 88, for example a relay, located in a lower portion 9D of the box 9B.

Figure 9:
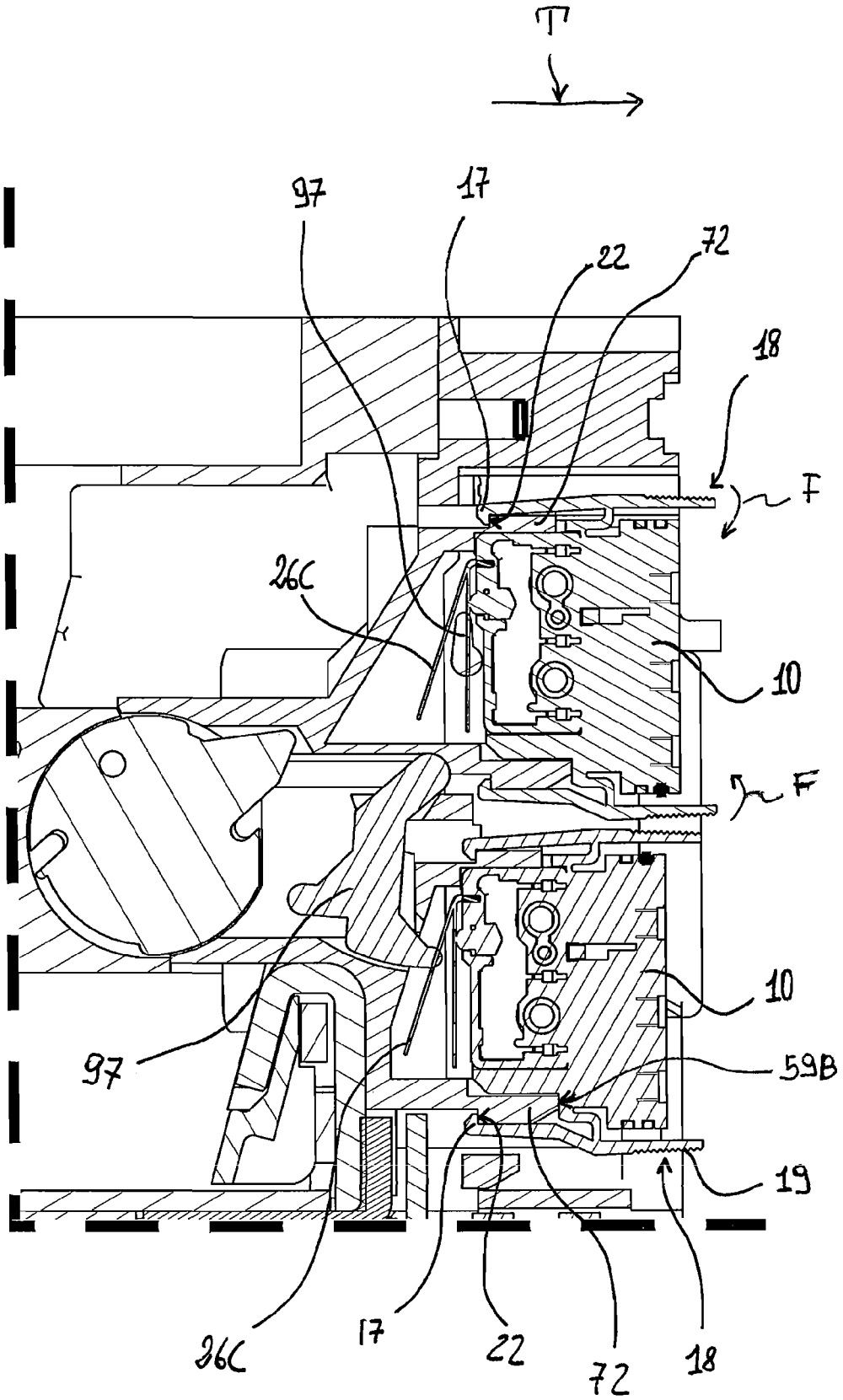
FIG. 9 is an enlargement of a portion of the view of FIG. 8.

FIG. 9 is a detailed view of details of FIG. 8. More precisely said FIG. 9 illustrates a pair of accessory devices 10 inserted individually in one of the non-removable containment structures 20 defined inside the box 9B of the case 9. As can be seen, the non-removable containment structure 20 comprises a pair of reciprocally opposed connection walls 72 each of which defines a coupling surface 22 for the coupling means 15. More specifically, the opposed connection walls 72 extend in a direction T substantially square to the back surface 8 of the switch 1 and define coupling surfaces 22 which are substantially parallel to said back surface 8.

In the solution of FIG. 9, the two connection walls 72 are arranged so as to permit insertion of the accessory device 10 in a vertical direction (visible for example from FIG. 6) with respect to a vertical installation of the switch 1. It is understood, however, that the connection walls 72 could be reciprocally arranged so as to permit insertion of the accessory device 10 in a horizontal direction again with respect to a vertical installation of the switch 1.

With reference to FIG. 9 and FIG. 7, the containment structure 20,20B,20C according to the invention is advantageously provided with second guide means which interact, during insertion of the accessory device 10, with first guide means predisposed on said accessory device. Said interaction has the purpose of guiding insertion of the accessory device 10, facilitating the assembly operations. In detail in the solution illustrated the second guide means comprise guide grooves 71B obtained on an inner side of one of the connection walls 72. In each of these grooves a guide end 71 is inserted emerging from one of the lateral surfaces of the accessory device 10 illustrated in FIG. 5. Each connection wall 72 is furthermore provided with a second locating surface 59B which provides a stop for the first locating surface 59 defined by a portion of the guide end 71 of the accessory device 10.

In practical terms, insertion of the accessory device 10 in the corresponding containment structure 20,20B,20C is performed substantially according to the following phases. The accessory device 10 is moved near the containment structure 20,20B,20C so that the guide end 71 fits into the guide groove 71B obtained on the inner side of one of the connection walls 72. The accessory device 10 is then pushed inside the containment structure 20,20B,20C until the two ends 17 of the two coupling levers 16 couple with the corresponding coupling surface 22 defined on the outer side of one of the connection walls 72.

As can be seen also from FIG. 8, once the accessory devices 10 are inserted in the containment structures 20,20B, 20C, the actuation portions 19 of the second lever arm 18 can be accessed by an operator to permit extraction if necessary of the relative accessory devices. In detail, said extraction requires a preliminary action on the actuation portion 19 in the directions indicated by the arrow F in FIG. 9. Said action determines, by a lever effect around the fulcrum portion 14, lifting of the coupling ends 17 which leaves the accessory device 10 free to be extracted from the containment structure 20.

FIG. 9 shows in detail also a first possible configuration of the operative interface means 25 operatively combined with the containment structures 20 in question. In detail said interface means 25 comprise at least one relay lever 97 which is operatively connected to the control means 7 so as to take on one or more characteristic positions corresponding to the same number of operating positions of the contact pairs. The relay lever 97 acts directly on the operating means 26 of the accessory device 10 which, as indicated above, transforms a mechanical type input signal into an electric signal which is made available via the interface means predisposed on the second operating surface 45.

Figure 10:
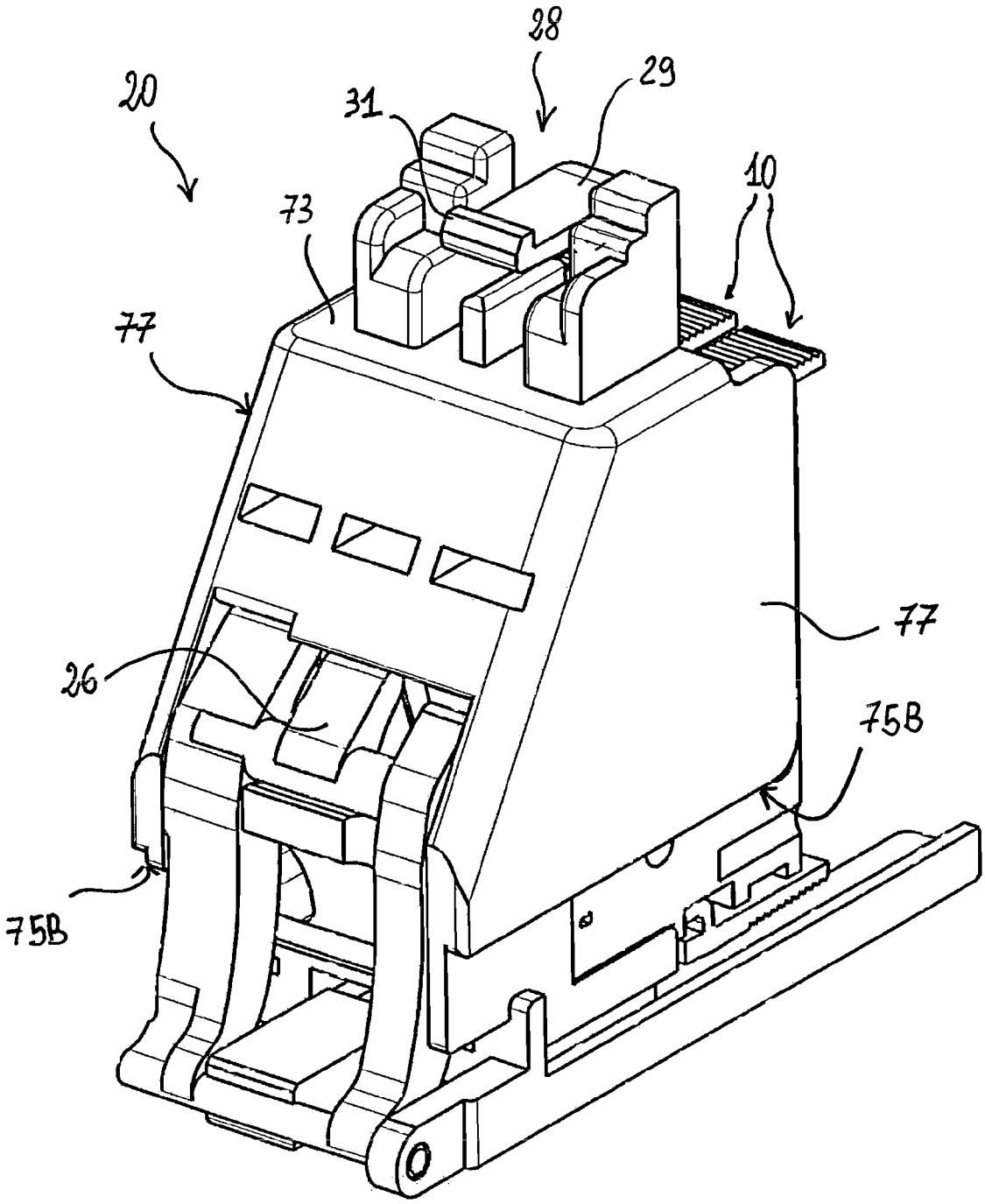
FIG. 10 is a first perspective view of an embodiment of a removable containment structure of a switching device according to the present invention in which a plurality of accessory devices are inserted.
Figure 11:
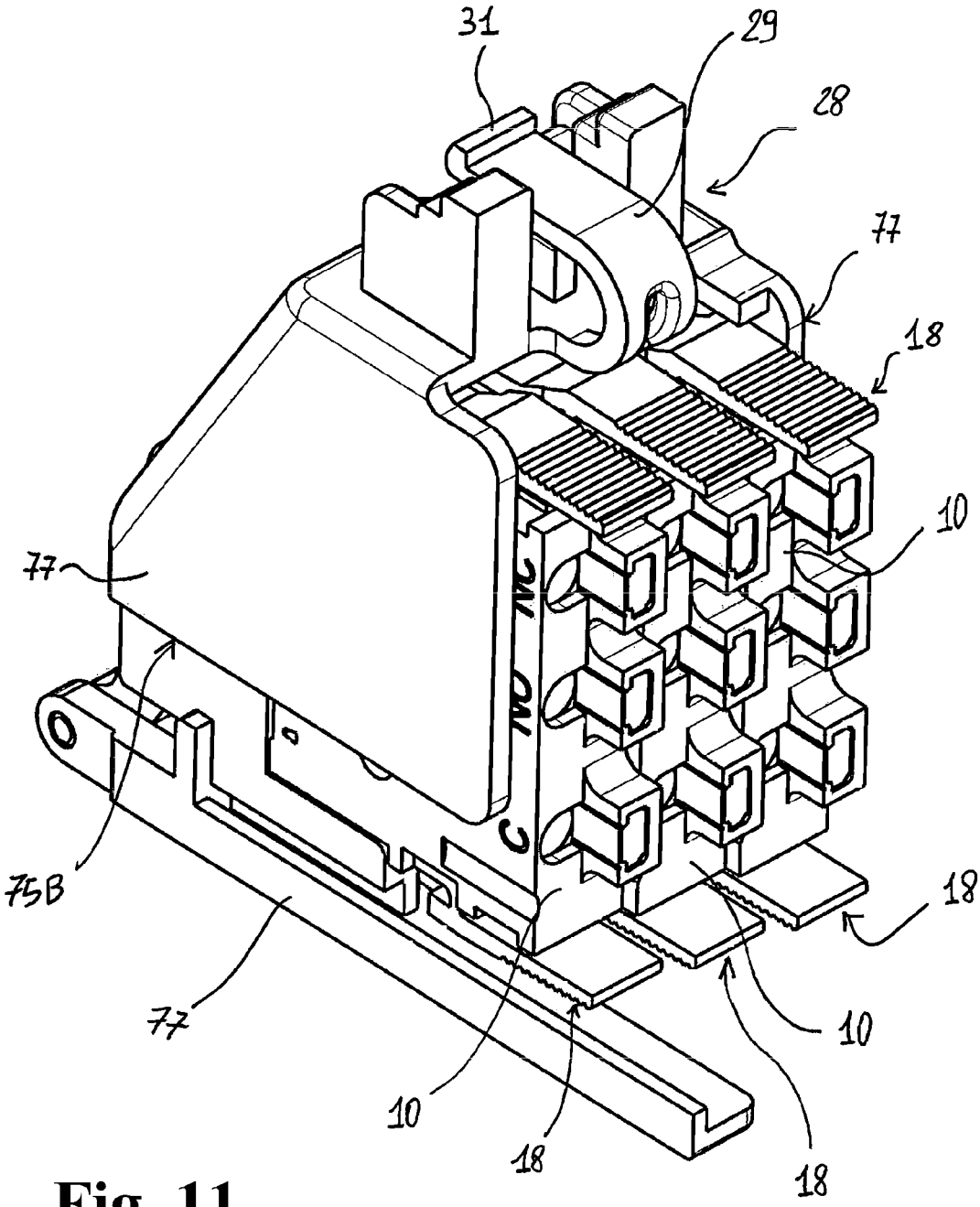
FIGS. 11 and 12 are a second perspective view and a frontal view respectively of the containment structure illustrated in FIG. 10.

FIGS. 10 and 11 are views (from opposite observation points) of a possible embodiment of a containment structure 20B which can be inserted in a removable manner in the box 9B of a case 9. The containment structure 20B is structured so as to define a seat inside which a plurality of accessory devices 10 are located. The structure 20B comprises an external frame defined by a first pair of opposite lateral containment surfaces 77, a lower surface 73B (see FIG. 13) and an upper surface 73, both square to the preceding surfaces and substantially opposite each other. The containment structure 20B furthermore comprises a pair of connection walls 72 each of which develops inside the external frame so as to face the lower surface 73B or the upper surface 73.

The removable containment structure 20B is provided with further coupling means 28 to couple the same to a housing cavity 50 defined inside the box 9B of the case 9 (see FIG. 7). Said further coupling means 28 comprise a flexible end 29 provided with a first coupling portion 31 designed to contact a second coupling portion 32 defined by a wall of the housing cavity 50.

As illustrated in FIG. 11 the upper coupling surface 73 is provided with third guide means suitable for guiding insertion of the containment structure 20B into the housing cavity 50. In particular said first guide means interact with fourth guide means defined inside the housing cavity 50B.

In the embodiment illustrated the third guide means comprise a pair of shoulders 75B each of which is defined on the outer side of a lateral coupling wall 77. The fourth guide means comprise a pair of sliding surfaces 55B (see FIG. 7) each of which emerges from a lateral wall 56 of the housing cavity 50. During insertion of the structure 20B, each shoulder 75B slides in a stable manner over one of the sliding surfaces 55B, thus making the insertion extremely simple and effective.

Figure 13:
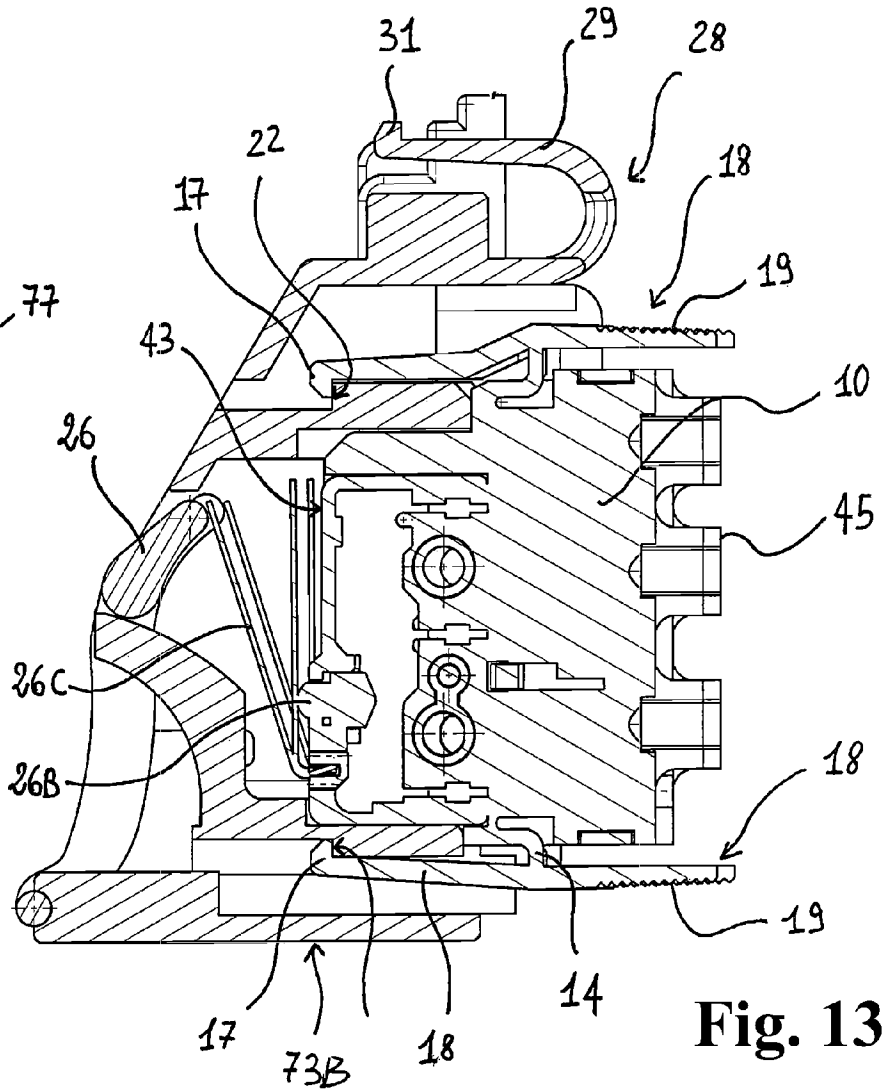
FIG. 13 is a section view according to the line XIII-XIII of FIG. 12.
Figure 12:
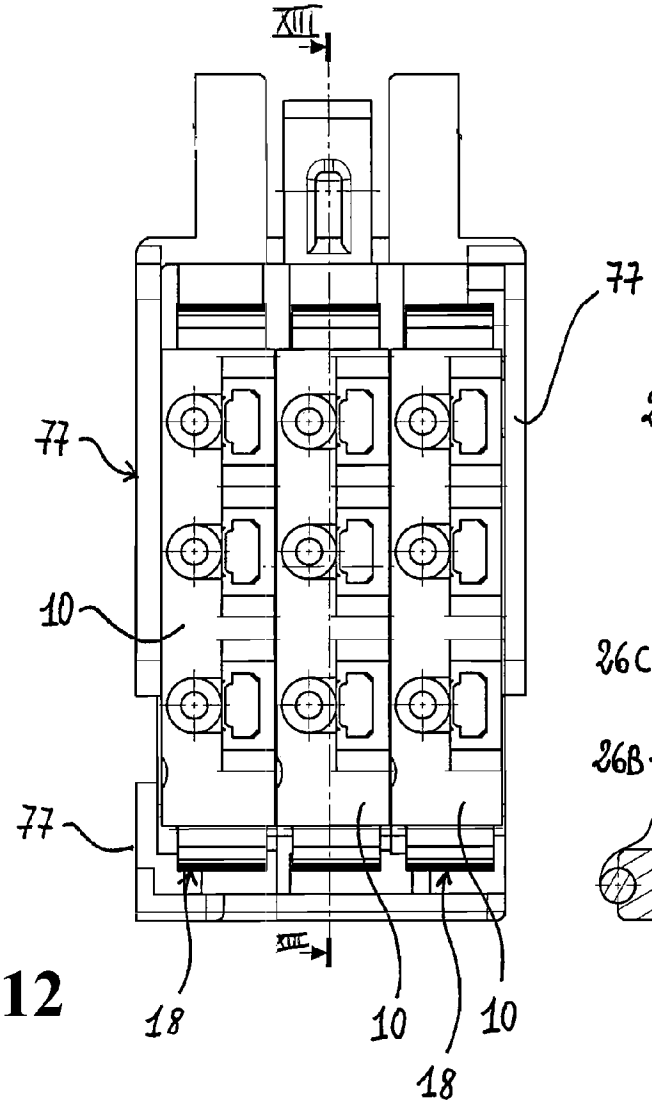

FIG. 12 is a frontal view of the containment structure 20B in which it can be seen that the accessory devices 10 are inserted vertically, similarly to the containment structures 20 made in one single piece with the box 9B. FIG. 13 is a section view of the structure of FIG. 12 and shows the mode of connection of the accessory device 10 to the removable structure 20B. Here again, there is a perfect analogy with the technical solutions indicated above.

Figure 14:
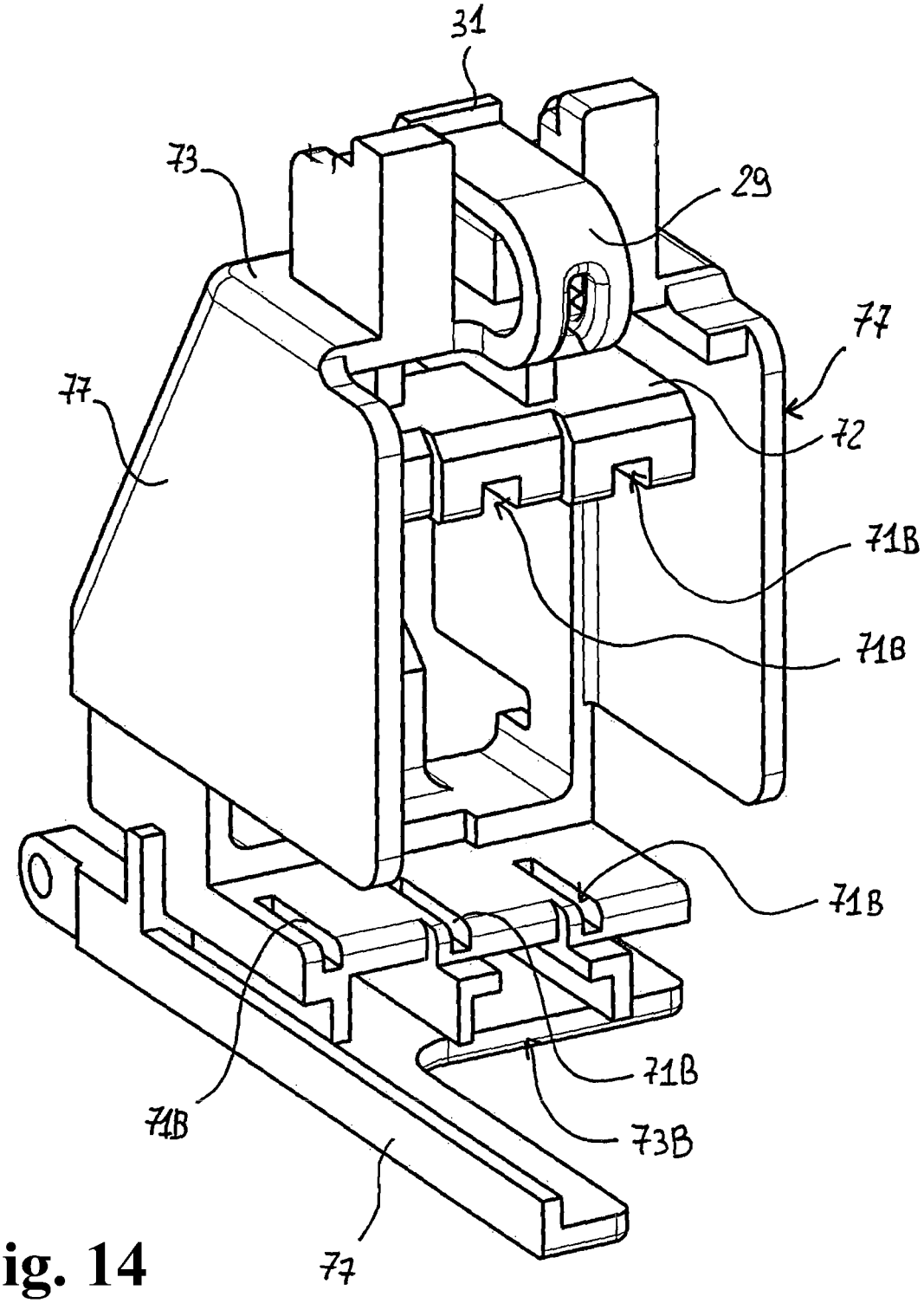
FIG. 14 is a view of the containment structure of FIG. 12 without the plurality of accessory devices.

Again in said regard FIG. 14 illustrates the removable structure 20B of FIG. 12 without the accessory devices 10. As shown, the connection walls 72 are also in this case provided with guide grooves 71B to guide the guide end 71 emerging from the lateral surfaces of the accessory device 10 according to the purposes indicated above.

Figure 15:
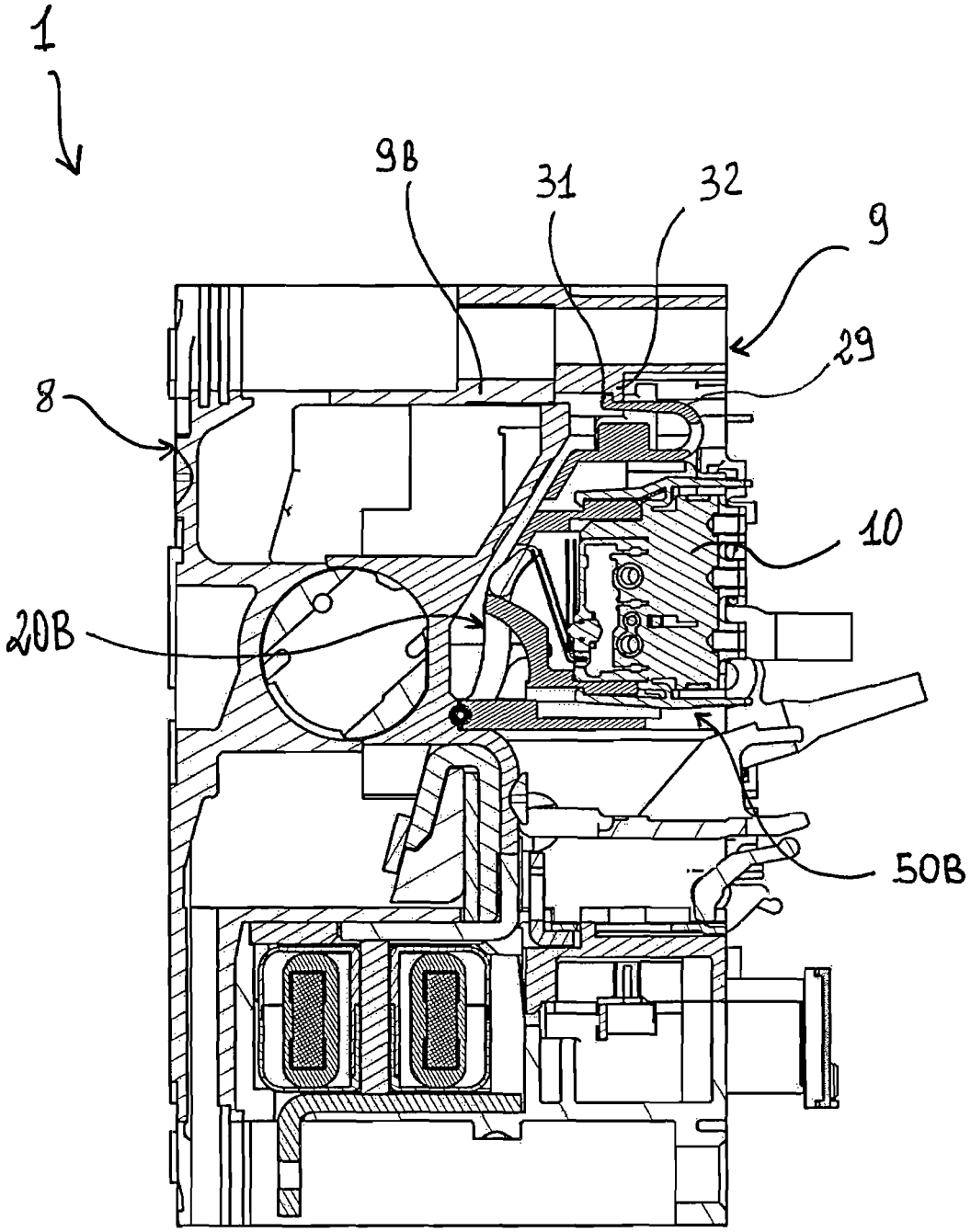
FIG. 15 is a view according to the line XIV-XIV of FIG. 6.

FIG. 15 is a section view according to the line XIV-XIV of FIG. 14 which illustrates the containment structure 20B inserted in the housing cavity 50B defined by the box 9B of the case 9. As can be seen, the flexible coupling end 29 connects, via the first coupling portion 31, to a second coupling portion defined on a wall of the housing cavity 50B which faces the upper wall 73 of the containment structure 20B once the same has been inserted.

Figure 16:
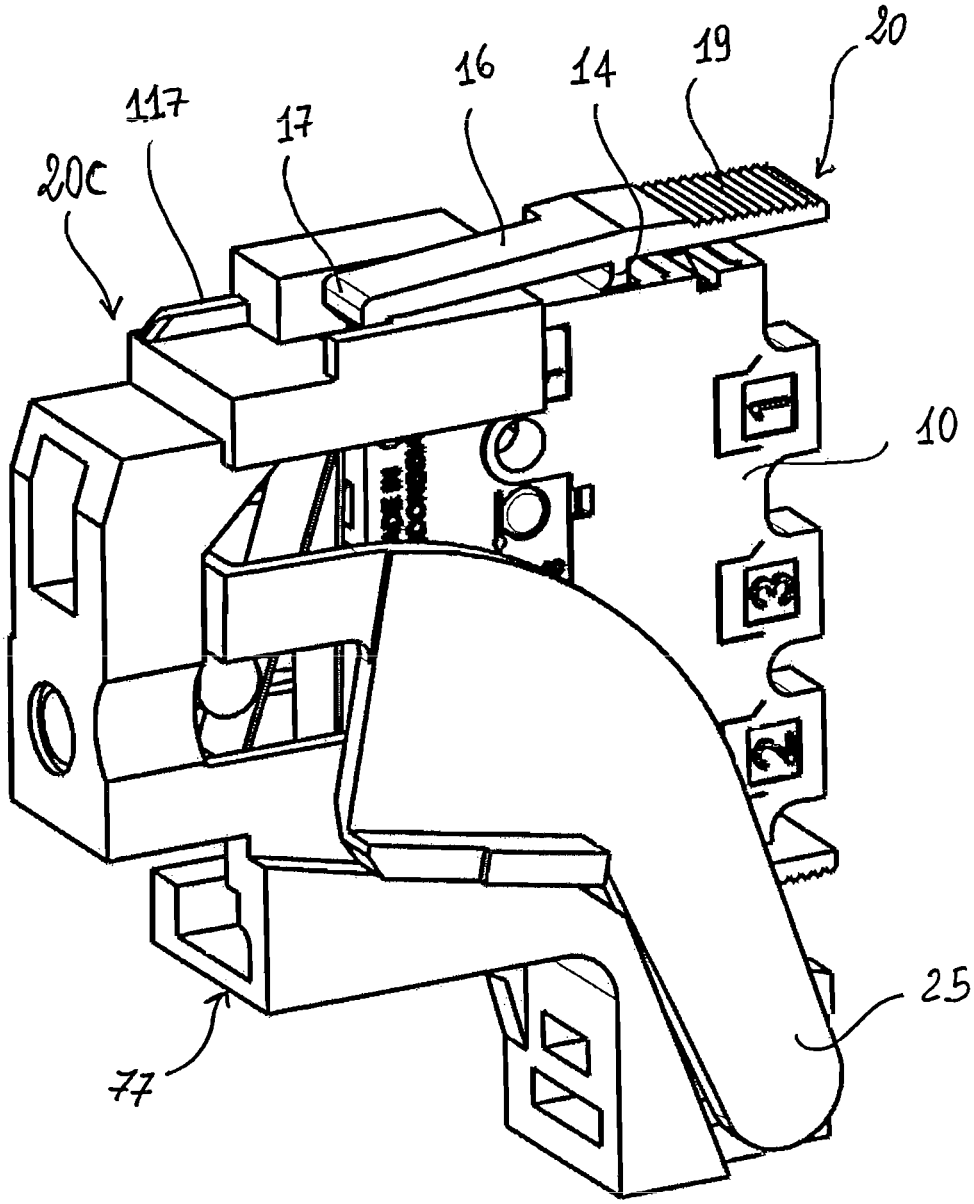
FIG. 16 is a perspective view of a further embodiment of a removable containment structure according to the present invention.

FIG. 16 relates to a second embodiment of a removable containment structure 20C according to the present invention. As can be seen, the structure 20C is configured to contain one single accessory device 10. In detail, also in this case the structure 20C comprises an external frame configured so as to fit in a stable manner in a corresponding housing cavity 50C preferably made in one single piece with the box 9B of the case 9. Two opposite connection walls 72 permit coupling of the accessory device 10 as already described, while at least one guide end 117 (as first guide means) emerges from a surface of the frame and fits in a sliding manner in a groove 118 (as second guide means) defined on one inner side of a wall of the housing cavity 50C in which the structure 20C is inserted.

The technical solutions adopted for the switching device according to the invention fully achieve the established purpose. In particular the arrangement of the disengagement devices on the structure of the accessory devices increases the dependability of the switch, at the same time simplifying the configuration of the containment structures that contain the accessories.

The switching device thus conceived is subject to numerous modifications and variations, all falling within the scope of the inventive concept; furthermore all the details can be replaced by other technical equivalents.

In practice, any materials and contingent dimensions and forms can be used according to requirements and the state of the art.

The invention claimed is:

1. A single-pole or multi-pole switching device for low voltage systems comprising a case containing at least one pair of contacts that can be reciprocally coupled/decoupled; at least one containment structure to contain at least one accessory device of said switching device, comprising means for interfacing with said accessory device; at least one accessory device comprising a body that can be inserted in said containment structure and provided with coupling means to couple it to said containment structure; said accessory device comprising operating means to interact with said switching device via said interface means of said at least one containment structure, said accessory device being provided with disengagement means operatively connected with said coupling means, said disengagement means, once activated, freeing said coupling means to permit the extraction of said accessory device from said containment structure; wherein said coupling means of said accessory device comprise a first lever arm pivoting on a flexible fulcrum portion emerging from a surface of said body of said accessory, said first lever arm comprising a free end which couples to a corresponding coupling surface of said containment structure when said accessory device is inserted in the structure; and wherein said disengagement means comprise a second lever arm provided with an actuation portion, said second lever arm being operatively connected to said first lever arm in order to free, when activated, said free coupling end from said coupling surface of said containment structure; wherein said first lever arm and said second lever arm develop on opposite sides with respect to said fulcrum portion and in such a way that said actuation portion of said second lever arm remains accessible once said accessory device is inserted in said containment structure; wherein said body comprises a first and a second flat surface substantially parallel to each other and at least one pair of reciprocally opposed lateral surfaces which develop in a direction substantially square to said flat surfaces, said coupling means comprising a pair of first lever arms each of which pivots on a fulcrum portion emerging from one of said opposed lateral surfaces, said disengagement means comprising a pair of second lever arms each of which are made in one single piece with a corresponding first lever arm, each of said second lever arms developing on a side opposite that of the corresponding first lever arm so that said actuation portion remains accessible once said accessory is inserted in said containment structure; wherein said body of said accessory comprises a first surface substantially square to said flat surfaces and to said opposed lateral surfaces, said operating means emerging from said first surface, said body comprising a second surface substantially opposite said first surface, said second surface comprising one or more connection terminals for the interface of said accessory device with other parts of said switching device.

2. The device as claimed in claim 1, wherein said accessory device comprises a first guide means for guiding the insertion of said accessory in said at least one containment structure, said containment structure comprising second guide means suitable for interacting with said first guide means during the insertion of said accessory device.

3. The device as claimed in claim 1, wherein said at least one containment structure is included in a non-removable manner inside said case of said switching device.

4. The device as claimed in claim 3, wherein said case comprises a box delimited by a back part and provided with a cover connected in a removable manner to said box in a position opposite said back part, said non-removable containment structure being made in one single piece with said box.

5. The device as claimed in claim 4, wherein said at least one non-removable containment structure comprises a pair of reciprocally opposed connection walls each of which defines a coupling surface for said coupling means of said accessory device, said connection walls extending in an opposite position to each other and in a direction substantially square to said back wall of said box.

6. The device as claimed in claim 1, wherein said at least one containment structure is inserted in a removable manner in a corresponding housing cavity defined inside said case.

7. The device as claimed in claim 6, wherein said coupling means of said accessory device comprise a first lever arm pivoting on a flexible fulcrum portion emerging from a surface of said body of said accessory, said first lever arm comprising a free end which couples to a corresponding coupling surface of said containment structure when said accessory device is inserted in the structure.

8. The device as claimed in claim 6, wherein said case comprises a box delimited by a back part and provided with a cover connected in a removable manner to said box in an opposite position to said back part, said housing cavity being made in one single piece with said box.

9. The device as claimed in claim 8, wherein said at least one removable containment structure comprises an external frame comprising a pair of reciprocally opposed lateral containment surfaces, a lower surface and an upper surface, said removable containment structure furthermore comprising a pair of connection walls each of which defines a coupling surface for said coupling means of said accessory device, said connection walls extending in a reciprocally opposed position and facing said lower surface and said upper surface respectively.

10. The device as claimed in claim 9, wherein said at least one removable containment structure comprises further coupling means to couple it to a corresponding housing cavity, said further coupling means comprising a flexible end which emerges with respect to said upper surface, said flexible end comprising a first coupling portion which couples with a second coupling portion defined on a wall of said corresponding housing cavity.

11. The device as claimed in claim 8, wherein said at least one removable structure comprises guide means for guiding insertion of the same in said corresponding housing cavity, said housing cavity comprising another guide means suitable for interacting with said guide means during said insertion of said removable structure.

12. The device as claimed in claim 1, wherein said disengagement means and said coupling means are made in one single piece with said body of said accessory device.

13. The device as claimed in claim 12, wherein said at least one containment structure is inserted in a removable manner in a corresponding housing cavity defined inside said case.

14. The device as claimed in claim 12, wherein said at least one containment structure is inserted in a non-removable manner inside said case of said switching device.

15. The device as claimed in claim 12, wherein said coupling means of said accessory device comprise a first lever arm pivoting on a flexible fulcrum portion emerging from a surface of said body of said accessory, said first lever arm comprising a free end which couples to a corresponding coupling surface of said containment structure when said accessory device is inserted in the structure.

16. A single-pole or multi-pole switching device for low voltage systems comprising a case containing at least one pair of contacts that can be reciprocally coupled/decoupled; at least one containment structure to contain at least one accessory device of said switching device, comprising means for interfacing with said accessory device; at least one accessory device comprising a body that can be inserted in said containment structure and provided with coupling means to couple it to said containment structure; said accessory device comprising operating means to interact with said switching device via said interface means of said at least one containment structure, said accessory device being provided with disengagement means operatively connected with said coupling means, said disengagement means, once activated, freeing said coupling means to permit the extraction of said accessory device from said containment structure; wherein said at least one containment structure is inserted in a removable manner in a corresponding housing cavity defined inside said case; wherein said case comprises a box delimited by a back part and provided with a cover connected in a removable manner to said box in an opposite position to said back wall, said housing cavity being made in one single piece with said box; wherein said at least one removable containment structure comprises an external frame comprising a pair of reciprocally opposed lateral containment surfaces, a lower surface and an upper surface, said removable containment structure furthermore comprising a pair of connection walls each of which defines a coupling surface for said coupling means of said accessory device, said connection walls extending in a reciprocally opposed position and facing said lower surface and said upper surface respectively; wherein said at least one removable containment structure comprises further coupling means to couple it to a corresponding housing cavity, said further coupling means comprising a flexible end which emerges with respect to said upper surface, said flexible end comprising a first coupling portion which couples with a second coupling portion defined on a wall of said corresponding housing cavity.

17. The device as claimed in claim 16, wherein said coupling means of said accessory device comprise a first lever arm pivoting on a flexible fulcrum portion emerging from a surface of said body of said accessory, said first lever arm comprising a free end which couples to a corresponding coupling surface of said containment structure when said accessory device is inserted in the structure.

18. The device as claimed in claim 17, wherein said disengagement means comprise a second lever arm provided with an actuation portion, said second lever arm being operatively connected to said first lever arm in order to free, when activated, said free coupling end from said coupling surface of said containment structure.

19. The device as claimed in claim 18, wherein said first lever arm and said second lever arm develop on opposite sides with respect to said fulcrum portion and in such a way that said actuation portion of said second lever arm remains accessible once said accessory device is inserted in said containment structure.

20. The device as claimed in claim 19, wherein said body comprises a first and a second flat surface substantially parallel to each other and at least one pair of reciprocally opposed lateral surfaces which develop in a direction substantially square to said flat surfaces, said coupling means comprising a pair of first lever arms each of which pivots on a fulcrum portion emerging from one of said opposed lateral surfaces, said disengagement means comprising a pair of second lever arms each of which are made in one single piece with a corresponding first lever arm, each of said second lever arms developing on a side opposite that of the corresponding first lever arm so that said actuation portion remains accessible once said accessory is inserted in said containment structure.

* * * * *